US006336226B1

(12) United States Patent
Garcia

(10) Patent No.: US 6,336,226 B1
(45) Date of Patent: Jan. 8, 2002

(54) CONVERTIBLE GARMENT AND METHOD

(76) Inventor: Jorge A. Garcia, 1213 La Poblana Rd. Northwest, Albuquerque, NM (US) 87107

( * ) Notice: Subject to any disclaimer, the term of this patent is extended or adjusted under 35 U.S.C. 154(b) by 0 days.

(21) Appl. No.: 09/895,241

(22) Filed: Jun. 29, 2001

(51) Int. Cl.[7] ..... A41D 1/00
(52) U.S. Cl. ..... 2/227; 2/69; 383/4
(58) Field of Search ..... 2/69.79, 73, 78.1–78.3, 2/227, 242, 695, 80, 83, 269, 243.1; 383/4

(56) References Cited

U.S. PATENT DOCUMENTS 4,475,251 A 10/1984 Hopkins
4,485,493 A 12/1984 Leinoff
4,689,831 A 9/1987 Greenberger et al.
4,932,574 A 6/1990 Doshi
5,033,127 A 7/1991 Schmeltz
5,533,209 A 7/1996 Davis

*Primary Examiner*—Gloria M. Hale

(57) ABSTRACT

A convertible garment and method for providing pants that may be converted into a satchel, backpack, gun case or pillow. The convertible garment and method includes a pair of pants having a first leg portion, a second leg portion, and a lower torso portion. Each of the first and second leg portions is integrally coupled to and extends away from the lower torso portion. Each of a plurality of drawstrings is used for cinching various portions of the pants. A first of the drawstrings is attached to a free end of the first leg portion. A second of the drawstrings is attached to a free end of the second leg portion. A third of the drawstrings is attached to the first leg portion and positioned generally adjacent to the lower torso portion, and a fourth of the drawstrings is attached to the second leg portion and positioned generally adjacent to the lower torso portion.

7 Claims, 6 Drawing Sheets

CONVERTIBLE GARMENT AND METHOD

BACKGROUND OF THE INVENTION

1. Field of the Invention

The present invention relates to convertible garments and more particularly pertains to a new convertible garment and method for providing pants that may be converted into a satchel, backpack, gun case or pillow.

2. Description of the Prior Art

The use of convertible garments is known in the prior art. More specifically, convertible garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,475,251; U.S. Pat. No. 4,485,493; U.S. Pat. No. 4,932,574; U.S. Pat. No. 4,689,831; U.S. Pat. No. 5,033,127; and U.S. Pat. No. 5,533,209.

While these devices fulfill their respective, particular objectives and requirements, the aforementioned patents do not disclose a new convertible garment and method. The inventive device includes a pair of pants having a first leg portion, a second leg portion, and a lower torso portion. Each of the first and second leg portions is integrally coupled to and extends away from the lower torso portion. Each of a plurality of drawstrings is used for cinching various portions of the pants. A first of the drawstrings is attached to a free end of the first leg portion. A second of the drawstrings is attached to a free end of the second leg portion. A third of the drawstrings is attached to the first leg portion and positioned generally adjacent to the lower torso portion, and a fourth of the drawstrings is attached to the second leg portion and positioned generally adjacent to the lower torso portion.

In these respects, the convertible garment and method according to the present invention substantially departs from the conventional concepts and designs of the prior art, and in so doing provides an apparatus primarily developed for the purpose of providing pants that may be converted into a satchel, backpack, gun case or pillow.

SUMMARY OF THE INVENTION

In view of the foregoing disadvantages inherent in the known types of convertible garments now present in the prior art, the present invention provides a new convertible garment and method construction wherein the same can be utilized for providing pants that may be converted into a satchel, backpack, gun case or pillow.

The general purpose of the present invention, which will be described subsequently in greater detail, is to provide a new convertible garment and method apparatus and method which has many of the advantages of the convertible garments mentioned heretofore and many novel features that result in a new convertible garment and method which is not anticipated, rendered obvious, suggested, or even implied by any of the prior art convertible garments, either alone or in any combination thereof.

To attain this, the present invention generally comprises a pair of pants having a first leg portion, a second leg portion, and a lower torso portion. Each of the first and second leg portions is integrally coupled to and extends away from the lower torso portion. Each of a plurality of drawstrings is used for cinching various portions of the pants. A first of the drawstrings is attached to a free end of the first leg portion. A second of the drawstrings is attached to a free end of the second leg portion. A third of the drawstrings is attached to the first leg portion and positioned generally adjacent to the lower torso portion, and a fourth of the drawstrings is attached to the second leg portion and positioned generally adjacent to the lower torso portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new convertible garment and method apparatus and method which has many of the advantages of the convertible garments mentioned heretofore and many novel features that result in a new convertible garment and method which is not anticipated, rendered obvious, suggested, or even implied by any of the prior art convertible garments, either alone or in any combination thereof.

It is another object of the present invention to provide a new convertible garment and method which may be easily and efficiently manufactured and marketed.

It is a further object of the present invention to provide a new convertible garment and method which is of a durable and reliable construction.

An even further object of the present invention is to provide a new convertible garment and method which is susceptible of a low cost of manufacture with regard to both materials and labor, and which accordingly is then susceptible of low prices of sale to the consuming public, thereby making such convertible garment and method economically available to the buying public.

Still yet another object of the present invention is to provide a new convertible garment and method which provides in the apparatuses and methods of the prior art some of the advantages thereof, while simultaneously overcoming some of the disadvantages normally associated therewith.

Still another object of the present invention is to provide a new convertible garment and method for providing pants that may be converted into a satchel, backpack, gun case or pillow.

Another object of the present invention is to provide a new convertible garment and method for providing pants that may be worn over conventional pants.

Yet another object of the present invention is to provide a new convertible garment and method which includes a pair of pants having a first leg portion, a second leg portion, and a lower torso portion. Each of the first and second leg portions is integrally coupled to and extends away from the lower torso portion. Each of a plurality of drawstrings is used for cinching various portions of the pants. A first of the drawstrings is attached to a free end of the first leg portion. A second of the drawstrings is attached to a free end of the second leg portion. A third of the drawstrings is attached to the first leg portion and positioned generally adjacent to the lower torso portion, and a fourth of the drawstrings is attached to the second leg portion and positioned generally adjacent to the lower torso portion.

Still yet another object of the present invention is to provide a new convertible garment and method that may be worn as a traditional pair of pants but may also be converted into a gun case, a pillow, a satchel and a backpack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
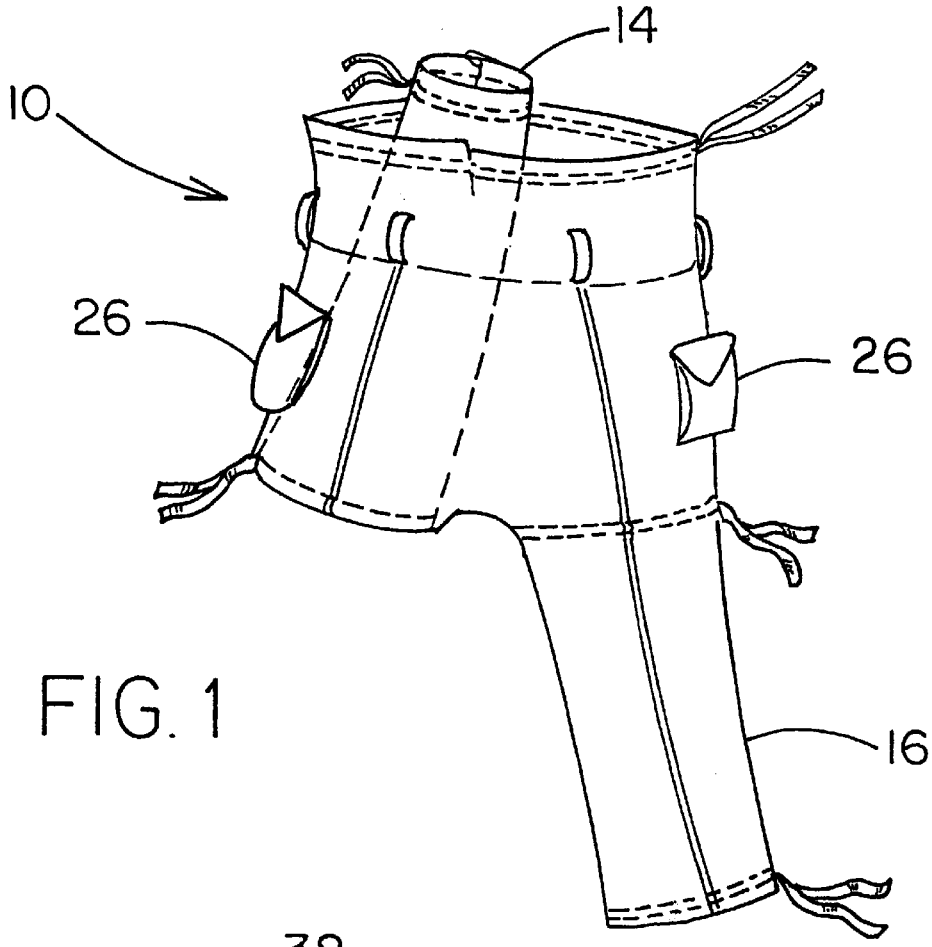
FIG. 1 is a schematic front view of a new convertible garment and method according to the present invention.

With reference now to the drawings, and in particular to FIGS. 1 through 12 thereof, a new convertible garment and method embodying the principles and concepts of the present invention and generally designated by the reference numeral 12 will be described.

As best illustrated in FIGS. 1 through 12, the convertible garment and method 10 generally comprises a pair of pants 12 having a first leg portion 14, a second leg portion 16, and a lower torso portion 18 for covering the lower torso of a person. Each of the first 14 and second 16 leg portions is integrally coupled to and extends away from the lower torso portion 18. The lower torso portion 18 has a middle annular band extending around the torso portion defining a waistline 20. A portion of the lower torso portion 18 extends above the waistline for comfort of the wearer and for providing many uses for the pants as will be discussed below. Each of a plurality of loops 22 is securely attached to the waistline 20. Each of the loops 22 is spaced from each other. The lower torso portion 18 has a front side having an elongated slot 24 extending therethrough. The slot 24 is positioned between the waistline 20 and the leg portions 14, 16. The slot 24 is in an angular relationship with the waistline 20.

Each of a pair of pocket members 26 is securely coupled to the lower torso portion 18 and positioned generally adjacent to one of the first 14 and second 16 leg portions.

A plurality of conventional drawstrings for cinching various portions of the pants 12 is attached to the pants 12. A first 28 of the drawstrings is attached to a free end of the first leg portion 14. A second 30 of the drawstrings is attached to a free end of the second leg portion 16. A third 32 of the drawstrings is attached to the first leg portion 14 and positioned generally adjacent to the lower torso portion 18. A fourth 34 of the drawstrings is attached to the second leg portion 16 and positioned generally adjacent to the lower torso portion 16. A fifth 36 of the drawstrings is attached to a free edge of the lower torso portion 18. Each of the drawstrings extends around the respective portion of the pants 12 and may be selectively tightened or loosened.

An elongated flexible member 38 has a first end 40 and a second end 42 and defines a strap. The strap is positionable in the loops 22. A coupler 44 is securely attached to the first end 40 of the elongated flexible member 38 and is adapted for removably securing the first end 40 to the second end 42.

A flap 46 for positioning over the slot 24 in the lower torso portion 18 comprises a panel having a first edge 48 securely attached to the lower torso portion 18 and extending along an edge of the slot 24. The flap has a second edge 50 positioned opposite of the first edge 48. A fastening means 52 removably fastens the second edge 50 to the lower torso portion 18 such that the flap 46 generally covers the slot 24. The fastening means 52 comprises a hook and loop fastening means including a hook portion securely attached to the flap and a loop portion is securely attached to the lower torso portion. The fastening means may also be a zipper or buttons.

Figure 2:
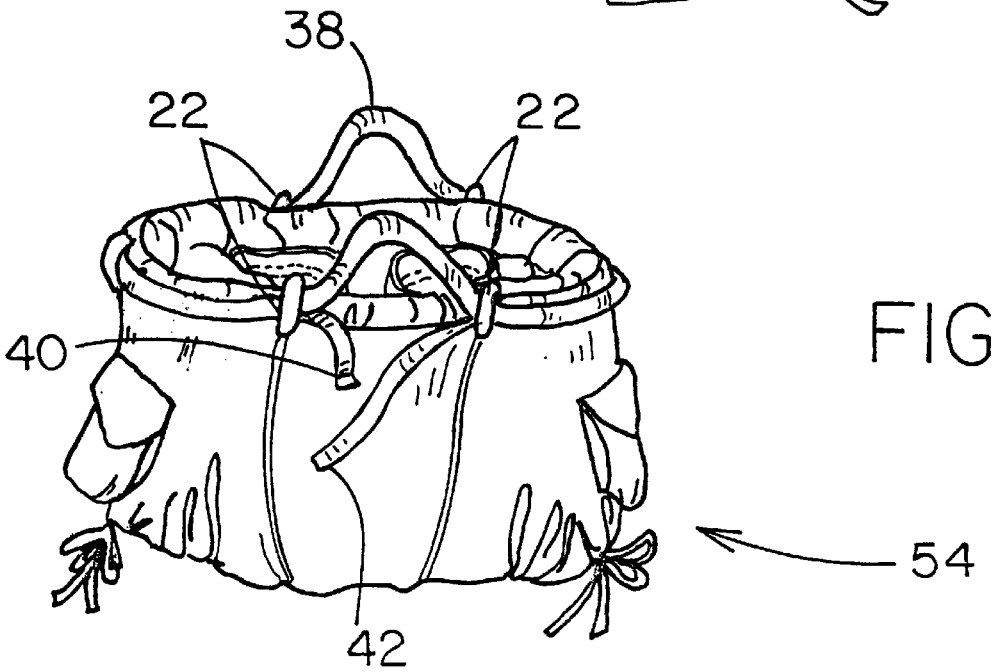
FIG. 2 is a schematic front view of the satchel conversion of the present invention.
Figure 3:
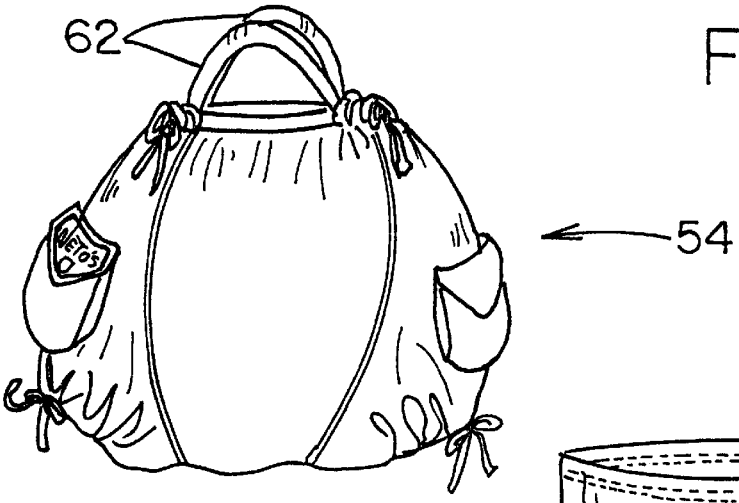
FIG. 3 is a schematic front view of the satchel of the present invention.

In use, the pants 12 are to be worn over other pants, but the pants may be worn without undergarments. The pants 12 may be converted into a satchel 54, backpack 56, a gun case 58, or a pillow 60. The pants 12 are converted into the satchel 54 by inverting the first 14 and second 16 leg portions and pulling the first 14 and second 16 leg portions into an interior of the lower torso portion 18 as shown in FIG. 1. Tightening the third 32 and fourth 34 drawstrings, and extending the strap 38 through the loops 22 such that the strap 38 extends around the lower torso portion 18 twice. Lifting a pair of generally oppositely positioned portions of the strap 38 extending between a pair of loops creates handles 62 as shown in FIGS. 2 and 3.

Figure 4:
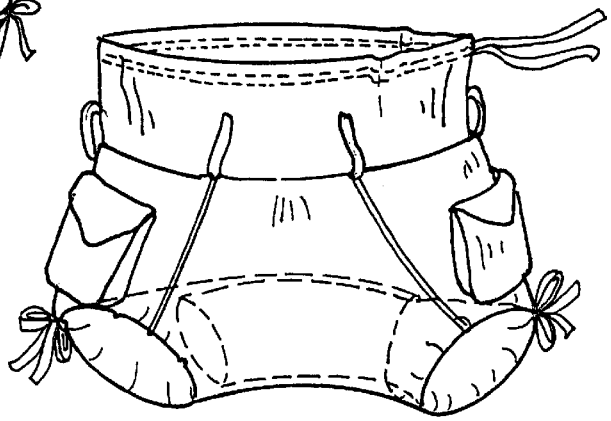
FIG. 4 is a schematic front view of the backpack of the present invention.
Figure 5:
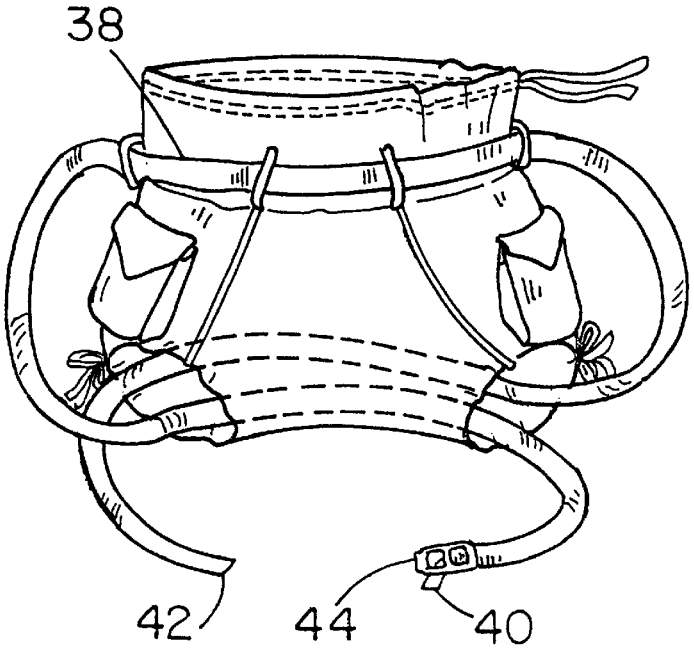
FIG. 5 is a schematic front view of the backpack of the present invention.
Figure 6:
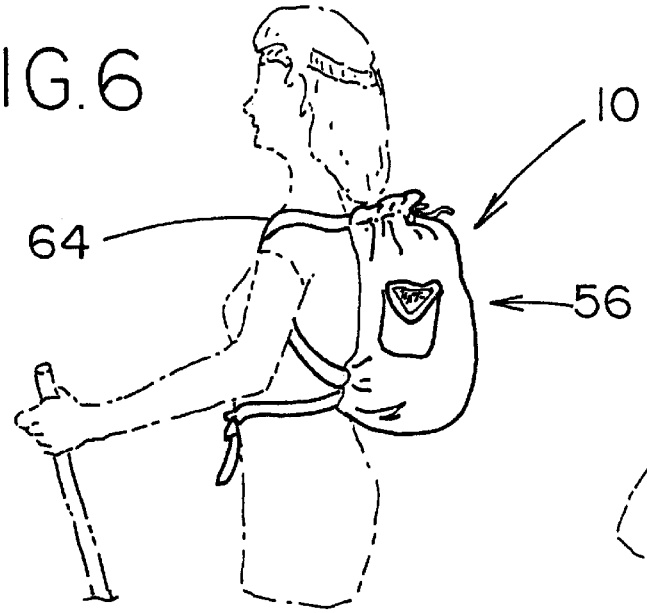
FIG. 6 is a schematic side view of the backpack of the present invention.
Figure 7:
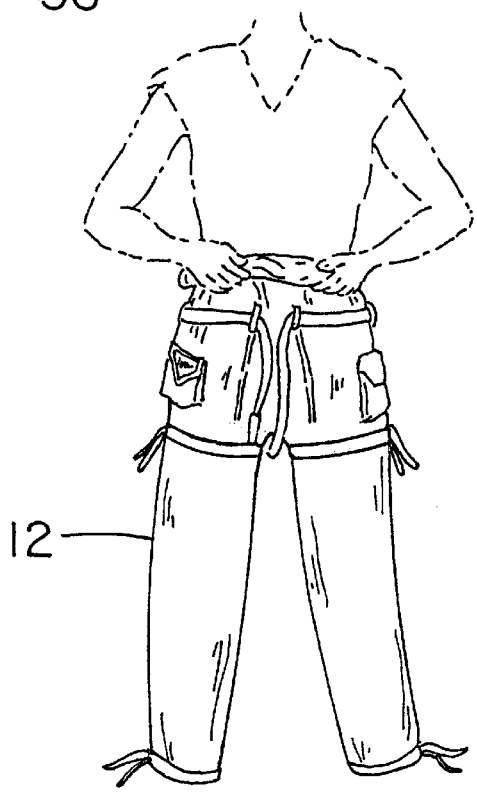
FIG. 7 is a schematic front view of the present invention.

The pants 12 are converted into a backpack 56 by inverting the first 14 and second 16 leg portions, pulling the first and second portions into an interior of the lower torso portion 18, and extending the second leg portion 16 into the first leg portion 14 as shown in FIG. 4. Positioning the strap 38 through the loop members 22 positioned on a front side of the lower torso portion 18, extending the first end 40 of the strap 38 into the first leg 14 and outwardly through the second leg 16, and extending the second end 42 of the strap 38 into the second leg 16 and outwardly through the first leg 14 as shown in FIG. 5. The portions of the strap extending from the loops 22 to the legs 14, 16 form shoulder straps 64 and the portions extending outwardly of the leg portions 14, 16 may be secured around the waist of a user as shown in FIG. 6. The fifth drawstring 36 is used to cinch closed the top of the backpack/satchel when necessary.

Figure 11:
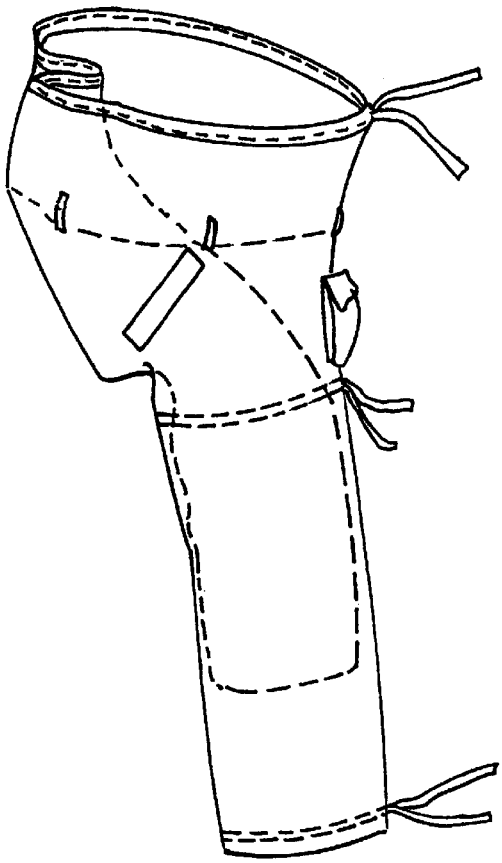
FIG. 11 is a schematic front view of the present invention.
Figure 12:
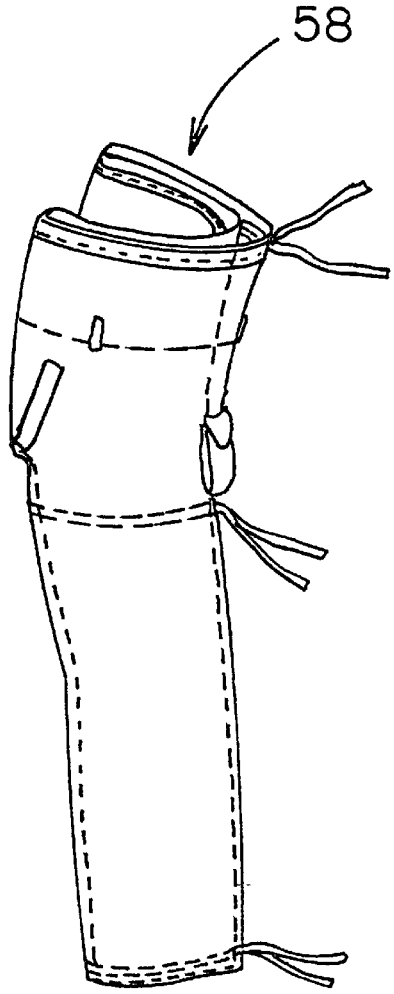
FIG. 12 is a schematic front view of the gun case conversion of the present invention.

The pants 12 are converted into the gun case 58, FIG. 12, by inverting the first leg 14 and extending the first leg 14 into the second leg 16, as shown in FIGS. 11 and 12, and tightening the second drawstring 30 to close the lower end of the case such that a gun may be extended into the second leg through the lower torso portion. The fifth drawstring 36 is then tightened to close the upper end of the case. The strap 38 may be extended through the exposed loops and fastened to the barrel of the gun to form a harness.

Figure 8:
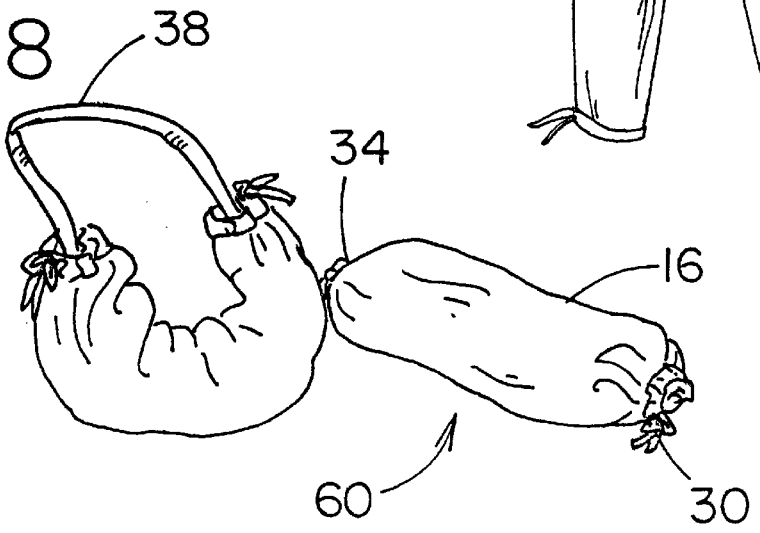
FIG. 8 is a schematic front view of the pillow conversion of the present invention.
Figure 9:
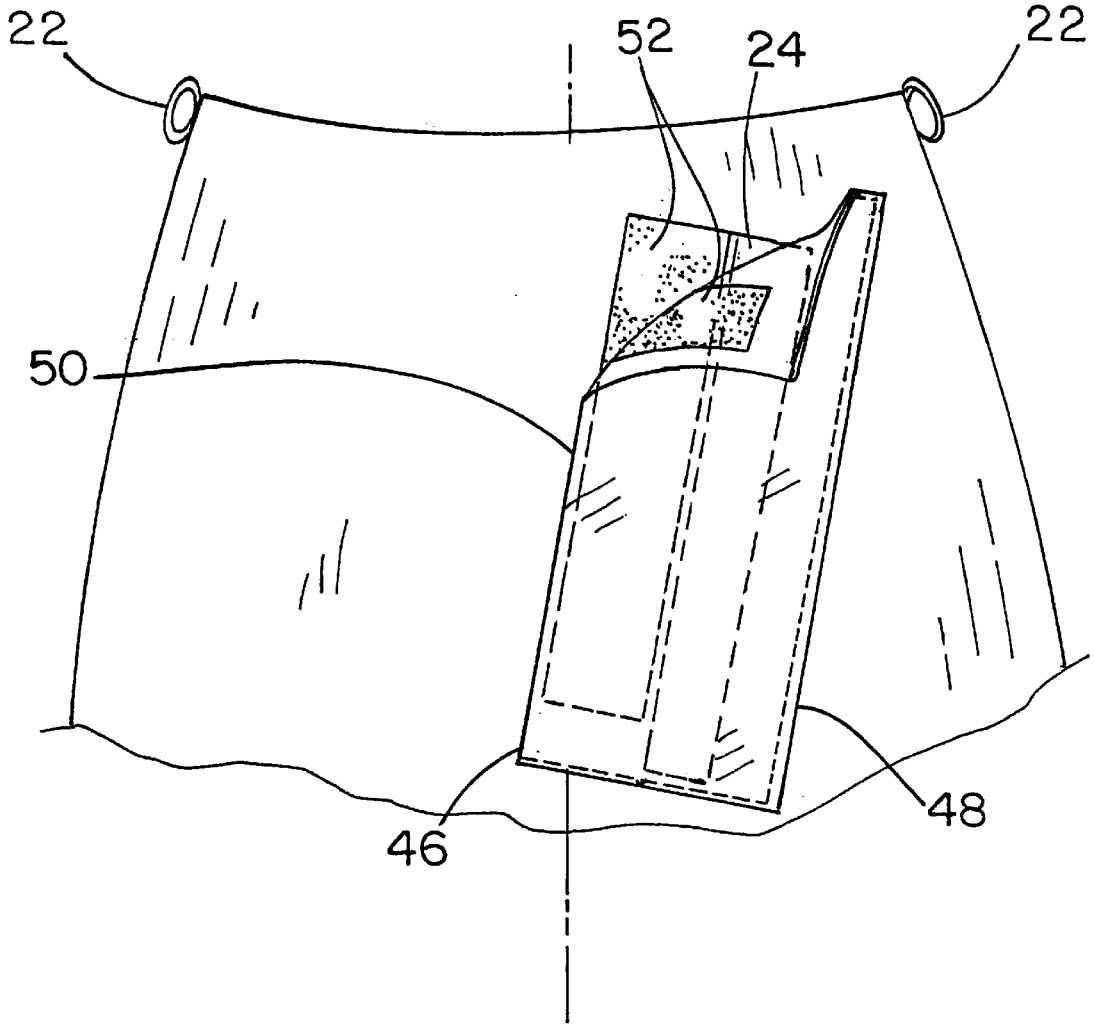
FIG. 9 is a schematic front view of the panel of the present invention.
Figure 10:
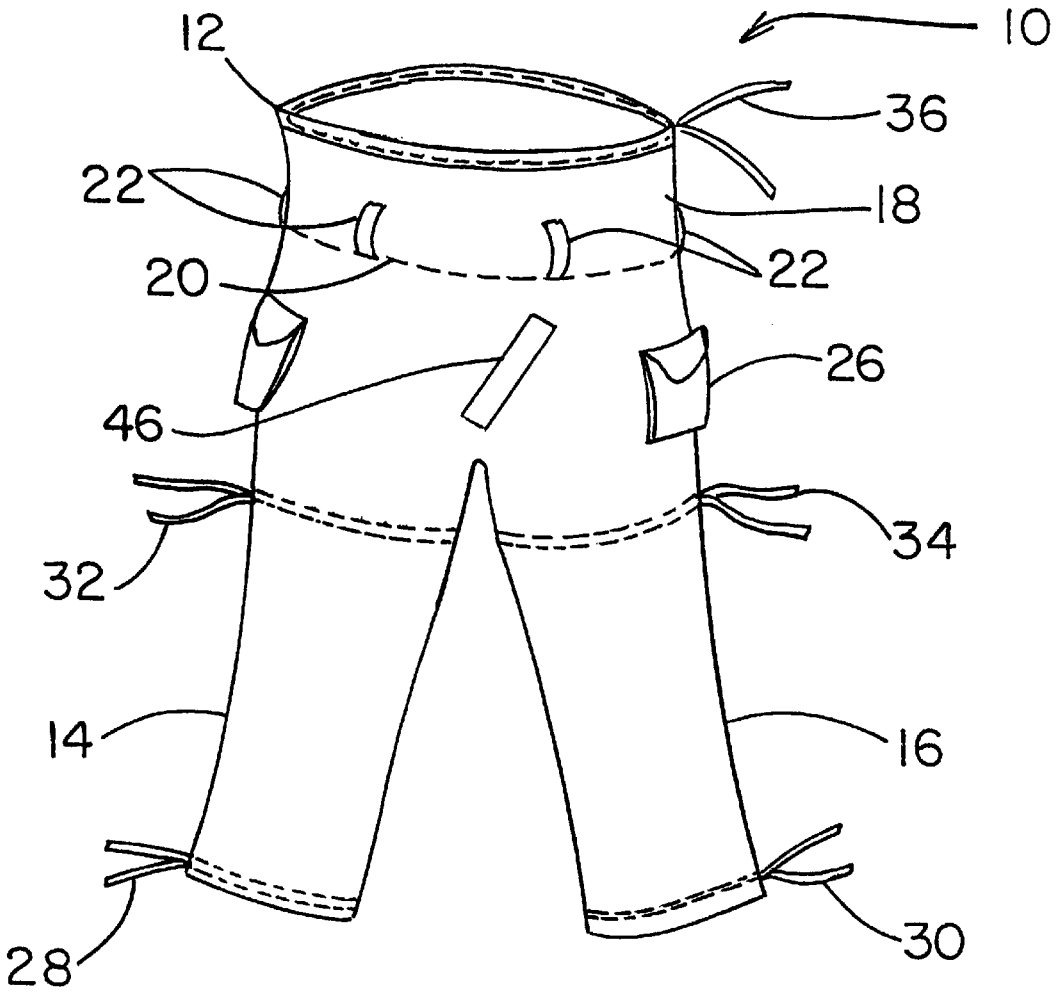
FIG. 10 is a schematic front view of the present invention.

The pants 12 are converted into a pillow, FIG. 8, by inverting the first leg 14 and extending the first leg 14 into the second leg 16, as shown in FIGS. 11 and 12. The lower torso portion 18 is inverted into the first leg portion 14 such that the lower torso portion 18 and the first leg portion 14 are positioned within the second leg portion 16. The second 30 and the fourth 36 drawstrings are tightened after stuffing the pants with other garments, or may be left open for use as a hand warmer, leg splint or arm splint. FIG. 8 also shows how the strap 38 may be extended through the pants 12 so that the pants may be carried on a shoulder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method comprising the steps of:

providing a pair of pants, said pants having a first leg portion, a second leg portion, and a lower torso portion, each of said first and second leg portions are integrally coupled to and extend away from said lower torso portion, said lower torso portion having a middle annular band extending around said torso portion defining a waistline, a plurality of loops being securely attached to said waistline, each of said loops being spaced from each other, said lower torso portion having a front side having an elongated slot extending therethrough, said slot being positioned between said waistline and said leg portions, said slot being in an angular relationship with said waistline;

providing a pair of pocket members, each of said pocket members being securely coupled to said lower torso portion and positioned generally adjacent to one of said first and second leg portions;

providing a plurality of drawstrings for cinching various portions of said pants, a first of said drawstrings being attached to a free end of said first leg portion, a second of said drawstrings being attached to a free end of said second leg portion, a third of said drawstrings being attached to said first leg portion and positioned generally adjacent to said lower torso portion, a fourth of said drawstrings being attached to said second leg portion and positioned generally adjacent to said lower torso portion, a fifth of said drawstrings being attached to a free edge of said lower torso portion, wherein each of said drawstrings extends around the respective portion of said pants and may be selectively tightened or loosened;

providing an elongated flexible member having a first end and a second end and defining a strap, said strap being positionable in said loops, a coupler being securely attached to said first end of said elongated flexible member and being adapted for removably securing said first end to said second end;

providing a flap for positioning over said slot in said lower torso portion, said flap comprising a panel having a first edge securely attached to said lower torso portion extending along an edge of said slot, said flap having a second edge positioned opposite of said first edge, a fastening means removably fastening said second edge to said lower torso portions such that said flap generally covers said slot, said fastening means comprising a hook and loop fastening means including a hook portion securely attached to said flap and a loop portion securely attached to said lower torso portion;

converting said pants into a satchel, a backpack, a gun case, or a pillow;

wherein the step of converting said pants into a satchel includes the steps of;

inverting said first and second leg portions and pulling said first and second leg portions into an interior of said lower torso portion;

tightening said third and fourth drawstrings;

extending said strap through said loops such that said strap extends around said lower torso portion twice;

lifting a pair of generally oppositely positioned portions of said strap extending between a pair of loops and defining a pair of handles;

wherein the step of converting said pants into a backpack includes the steps of;

inverting said first and second leg portions and pulling said first and second portions into an interior of said lower torso portion;

extending said second leg portion into said first leg portion;

positioning said strap through said loop members positioned on said front side of said lower torso portion, extending said first end of said strap into said first leg and outwardly through said second leg, extending said second end of said strap into said second leg and outwardly through said first leg;

wherein the step of converting said pants into a gun case includes the steps of;

inverting said first leg and extending said first leg into said second leg;

tightening said second drawstring, such that a gun may be extended into said second leg through said lower torso portion;

tightening said fifth drawstring;

wherein the step of converting said pants into a pillow includes the steps of;

inverting said first leg and extending said first leg into said second leg;

inverting said lower torso portion into said first leg portion such that said lower torso portion and said first leg portion are positioned with into said second leg portion;

tightening said second and said fourth drawstrings.

2. A method comprising the steps of:

providing a pair of pants, said pants having a first leg portion, a second leg portion, and a lower torso portion, each of said first and second leg portions are integrally coupled to and extend away from said lower torso portion; and providing a plurality of drawstrings for cinching various portions of said pants, a first of said drawstrings being attached to a free end of said first leg portion, a second of said drawstrings being attached to a free end of said second leg portion, a third of said drawstrings being attached to said first leg portion and positioned generally adjacent to said lower torso portion, a fourth of said drawstrings being attached to said second leg portion and positioned generally adjacent to said lower torso portion.

3. The method as in claim 2, further comprising the steps of:

converting said pants into a pillow, wherein converting said pants into pillow further includes the steps of;

inverting said first leg and extending said first leg into said second leg;

inverting said lower torso portion into said first leg portion such that said lower torso portion and said first leg portion are positioned with into said second leg portion; and tightening said second and said fourth drawstrings.

4. The method as in claim 2, further comprising the steps of:

providing a fifth of said drawstrings being attached to a free edge of said lower torso portion;

converting said pants into a gun case, wherein the step of converting said pants into a gun case includes the steps of;

inverting said first leg and extending said first leg into said second leg;

tightening said second drawstring, such that a gun may be extended into said second leg through said lower torso portion; and tightening said fifth drawstring.

5. The method as in claim 2, further including the steps of:

providing a plurality of loops being securely attached to a waistline, said waistline being defined by a middle annular band extending around said torso portion defining a waistline, each of said loops being spaced from each other, providing an elongated flexible member having a first end and a second end and defining a strap, said strap being positionable in said loops;

converting said pants into a backpack, wherein the step of converting said pants into a backpack includes the steps of;

inverting said first and second leg portions and pulling said first and second portions into an interior of said lower torso portion;

extending said second leg portion into said first leg portion; and positioning said strap through said loop members positioned on said front side of said lower torso portion, extending said first end of said strap into said first leg and outwardly through said second leg, extending said second end of said strap into said second leg and outwardly through said first leg.

6. The method as in claim 5, further including the steps of:

converting said paints into a satchel, wherein the step of converting said pants into a satchel includes the steps of;

inverting said first and second leg portions and pulling said first and second leg portions into an interior of said lower torso portion;

tightening said third and fourth drawstrings;

extending said strap through said loops such that said strap extends around said lower torso portion twice; and lifting a pair of generally oppositely positioned portions of said strap extending between a pair of loops, such that each of said portions defines a handle.

7. The method as in claim 2, further including the steps of:

wherein the step of providing pair of pants includes said lower torso portion having a front side having an elongated slot extending therethrough; and providing a flap for positioning over said slot in said lower torso portion, said flap comprising a panel having a first edge securely attached to said lower torso portion extending along an edge of said slot, said flap having a second edge positioned opposite of said first edge, a fastening means removably fastening said second edge to said lower torso portions such that said flap generally covers said slot.

* * * * *